US010941672B2

(12) United States Patent
Turner et al.

(10) Patent No.: US 10,941,672 B2
(45) Date of Patent: Mar. 9, 2021

(54) STATIONARY VANE NOZZLE OF GAS TURBINE

(71) Applicant: DOOSAN HEAVY INDUSTRIES & CONSTRUCTION CO., LTD., Changwon-si (KR)

(72) Inventors: Glenn David Turner, Seabrook, TX (US); Matthew Charles Lau, Shoreacres, TX (US); Ryan Lee Nutt, Crosby, TX (US)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 201 days.

(21) Appl. No.: 16/131,033

(22) Filed: Sep. 14, 2018

(65) Prior Publication Data

US 2020/0088056 A1 Mar. 19, 2020

(51) Int. Cl.

| | |
|---|---|
| ***F01D 11/06*** | (2006.01) |
| ***F01D 11/00*** | (2006.01) |
| ***F01D 9/04*** | (2006.01) |

(52) U.S. Cl.

CPC ..... *F01D 11/006* (2013.01); *F01D 9/041* (2013.01); *F01D 9/042* (2013.01); *F05D 2240/55* (2013.01); *F05D 2240/80* (2013.01)

(58) Field of Classification Search

CPC .... F01D 11/005; F01D 11/006; F01D 11/008; F01D 11/08; F01D 9/02; F01D 9/041;

(Continued)

(56) References Cited

U.S. PATENT DOCUMENTS 5,154,577 A * 10/1992 Kellock ..... F01D 11/005 277/641
6,916,021 B2 * 7/2005 Beeck ..... F01D 5/225 277/411

(Continued)

FOREIGN PATENT DOCUMENTS

JP 2001-123803 A 5/2001
JP 2013-155812 A 8/2013

(Continued)

OTHER PUBLICATIONS

A Korean Office Action dated Dec. 12, 2019 in connection with Korean Patent Application No. 10-2018-0122452 which corresponds to the above-referenced U.S. application.

*Primary Examiner* — Aaron R Eastman
*Assistant Examiner* — Maxime M Adjagbe
(74) *Attorney, Agent, or Firm* — INVENSTONE Patent, LLC

(57) ABSTRACT

Provided is a stationary nozzle assembly of a gas turbine including a plurality of vane segments converting hot gas energy into a kinetic form, a fixed seal disposed between two adjacent vane segments, and honeycomb seal elements disposed between the two adjacent vane segments to prevent hot gases from escaping through a gap between the two adjacent vane segments. Here, the fixed seal and the honeycomb seal elements face each other. In addition, the vane segments each include airfoil shaped vanes, an outer wall and an inner wall that are disposed at opposite sides of the airfoil shaped vanes, and the fixed seal and the honeycomb seal elements are installed in at least one of the outer wall or the inner wall.

20 Claims, 9 Drawing Sheets

(58) Field of Classification Search
CPC .. F01D 9/042; F05D 2240/10; F05D 2240/11; F05D 2240/80; F05D 2240/55; F16J 15/02; F16J 15/06
See application file for complete search history.

(56) References Cited

U.S. PATENT DOCUMENTS

| | | | | |
|---|---|---|---|---|
| 7,090,224 | B2 * | 8/2006 | Iguchi | F01D 11/005 277/603 |
| 9,341,072 | B2 * | 5/2016 | Hanumanthan | F01D 11/005 |
| 2016/0003079 | A1 * | 1/2016 | Boeke | F01D 11/005 415/1 |

FOREIGN PATENT DOCUMENTS

| | | | |
|---|---|---|---|
| JP | 2016-061294 | A | 4/2016 |
| JP | 2017-031972 | A | 2/2017 |

* cited by examiner

STATIONARY VANE NOZZLE OF GAS TURBINE

TECHNICAL FIELD

Exemplary embodiments of the present invention relate to a stationary or vane nozzle of a gas turbine, and more particularly, to a stationary vane or nozzle of a gas turbine having honeycomb seal elements disposed between the two adjacent vane segments to prevent hot gases from escaping the designed flow path between the two adjacent vane segments.

BACKGROUND

A turbine is a mechanical device that obtains rotational force by impulsive force or reaction force by using a flow of compressible fluid, such as steam or gas, and includes a steam turbine using steam, a gas turbine using high-temperature combustion gas, or the like.

The gas turbine is a rotary power engine that extracts energy from the flow of the combustion gas. The gas turbine includes a compressor, a turbine, and a combustion chamber. The compressed air pressurized by the compressor is mixed with fuel and then the mixture is combusted, such that high-temperature combustion gas expands, and the turbine is driven by this expansion force. Energy is transferred through a shaft as torque, or is obtained in the form of thrust or compressed air. This energy can be used to drive an aircraft, a generator, and so on.

The compressor is provided with an air inlet through which air is supplied to the compressor, and a plurality of compressor vanes and blades are disposed alternately in the compressor housing. The combustor supplies fuel to the compressed air compressed by the compressor and ignites it with a burner to generate high-temperature combustion gas.

A plurality of turbine vanes and turbine blades are disposed alternately in a housing of the turbine. Further, a rotor penetrating a center of the compressor, combustor, turbine and an exhaust is also provided therein.

Both ends of the rotor are rotatably supported by bearings. A plurality of disks is fixed to the rotor and the blades are connected to the rotor. Simultaneously, a drive shaft of, e.g., a generator is connected to an end of an exhaust chamber or in front of the compressor.

Since the gas turbine does not have a reciprocating mechanism such as a piston of a four-stroke engine, consumption of lubricating oil is extremely low due to the absence of a mutual friction part such as a piston-cylinder. The gas turbine is also advantageous in that the amplitude, which is a characteristic of reciprocating machines, is greatly reduced, thereby permitting high-speed rotational motion.

The thermodynamic cycle of a gas turbine ideally follows a Brayton cycle. The Brayton cycle consists of four phases including isentropic compression (adiabatic compression), static pressure heating, isentropic expansion (adiabatic expansion), and static pressure heat discharge. After sucking the atmospheric air and compressing it to a high-pressure, a fuel is combusted in a static pressure environment to release heat energy. A high-temperature combustion gas is then expanded and transformed into kinetic energy, and an exhaust gas containing residual energy is discharged into the atmosphere. Likewise, the Brayton cycle consists of four processes, i.e., compression, heating, expansion, and heat discharge.

The operation of the gas turbine is briefly described. Air compressed in the compressor is mixed with the fuel and combusted to generate high-temperature combustion gas, and the combustion gas generated is injected into the turbine blades and vanes. The injected combustion gas passes through the turbine vanes and blades and generates rotational force in the turbine blades, which eventually rotates the rotor coupled to the turbine blades.

It is important to reduce the leakage of the combustion gas from the designed flow path to improve turbine efficiency. Specifically, a designed thermal gap that may be present between adjacent vane segments. The gap may be a path for the leakage of the combustion gas, and a sealing mechanism is required to seal the gap to prevent such leakage.

SUMMARY

The present disclosure provides a stationary nozzle assembly of a gas turbine, which includes a plurality of vane segments converting hot gas energy into a kinetic form, a fixed seal disposed between two adjacent vane segments, and honeycomb seal elements disposed between the two adjacent vane segments to prevent hot gases from escaping through a gap between the two adjacent vane segments. The fixed seal and the honeycomb seal elements face each other.

In addition, the vane segments each include airfoil shaped vanes, an outer wall and an inner wall that are disposed at opposite sides of the airfoil shaped vanes, and the fixed seal and the honeycomb seal elements are installed in at least one of the outer wall or the inner wall.

The vane segments may be a single vane or have a plurality of vanes. A typical gas turbine has three or four stages of the turbine stator. The vane segments forming the stationary nozzle of the turbine stator may have different numbers of airfoil-shaped vanes. For example, a first stage stationary nozzle may include the vane segments having one or two airfoil-shaped vanes, and a second stage stationary nozzle may include the vane segments having two or three airfoil-shaped vanes.

The stationary nozzle assembly may be formed by connecting the plurality of vane segments along the circumferential direction. One vane segment may be sequentially coupled to an adjacent vane segment along the circumferential direction. Accordingly, the stationary nozzle assembly may be formed in an annular shape by combining the vane segments.

The turbine section of the gas turbine converts thermal energy of the combustion gas into rotational energy of the turbine as the high-temperature combustion gas passes, resulting in the rotation of the turbine disk.

When one of the vane segments is coupled to another vane segment, the high-temperature combustion gas may leak through a designed thermal gap between the two adjacent vane segments. Such leakage of the combustion gas reduces the turbine efficiency and therefore, adequate sealing is required between the two vane segments.

The vane segments are spaced apart from each other with a gap of a certain distance, which is referred to as a thermal gap because thermal expansion occurs due to the contact with the combustion gas. The butt gap may be able to prevent the friction with the adjacent vane segment when the vane segments are expanded due to the thermal growth caused by an increased in material temperature due to combustion gas. However, a leakage of the combustion gas through the butt gap is inevitable if the thermal expansion does not occur or is insufficient, resulting in reduction in the turbine efficiency.

A variety of methods can be used to inhibit the gas leakage between adjacent vane segments. A fixed seal may be provided on a vane segment in one side, a joint slot 175 may be located on a vane segment in the other side, and the seal and the slot may be installed to face each other, thereby preventing the leakage of the combustion gas.

Alternatively, in order to suppress the leakage between the adjacent vane segments, the stationary nozzle assembly may include a fixed seal fixed to the vane segment in one side, honeycomb seal elements attached to the vane segment in the other side while facing the fixed seal, and a backing strip supporting the honeycomb seal elements and providing an installation space for the honeycomb seal elements.

When two adjacent vane segments are coupled to each other, the fixed seal makes contact with the honeycomb seal elements. Therefore, the leakage of the combustion gas through a gap between the two adjacent vane segments may be suppressed by the coupling of the fixed seal and the honeycomb seal elements.

The fixed seal, the honeycomb seal elements, and the backing strip are preferably installed on an outer wall or an inner wall of the vane segment to suppress the leakage of the combustion gas through the gap between the two adjacent vane segments. Alternatively, in the stationary nozzle assembly according to an embodiment of the present invention, the fixed seal, the honeycomb seal elements, and the backing strip may be installed on both the outer wall and the inner wall of the vane segment.

The backing strip has a T-shape to allow the backing strip to be fixed to the vane segment. The outer wall and the inner wall of the vane segment according to an embodiment of the present invention may be provided with a slot groove capable of accommodating the backing strip.

In order to facilitate the coupling of the fixed seal and the honeycomb seal elements, the fixed seal may be provided with a chamfered edge at a portion where the fixed seal is coupled to the honeycomb seal elements. When the two adjacent vane segments are coupled with each other, the fixed seal on the vane segment in one side is coupled to sink into the honeycomb seal elements on the vane segment in the other side. In this manner, the chamfered edge of the fixed seal makes it easier to couple the fixed seal with the honeycomb seal elements.

The honeycomb seal elements are preferably made of a nickel alloy to have resistance to high-temperature and oxidation. For example, the honeycomb seal elements may be made of H-214 alloy, Hast-X alloy, or L-605 alloy. Materials of the honeycomb seal segments are not limited thereto, and the honeycomb seal segments may be formed of various other materials.

BRIEF DESCRIPTION OF THE DRAWINGS

These and/or other aspects, features, and advantages of the present disclosure will become apparent and more readily appreciated from the following description of example embodiments, taken in conjunction with the accompanying drawings of which.

DETAILED DESCRIPTION OF THE DISCLOSURE

Figure 1:
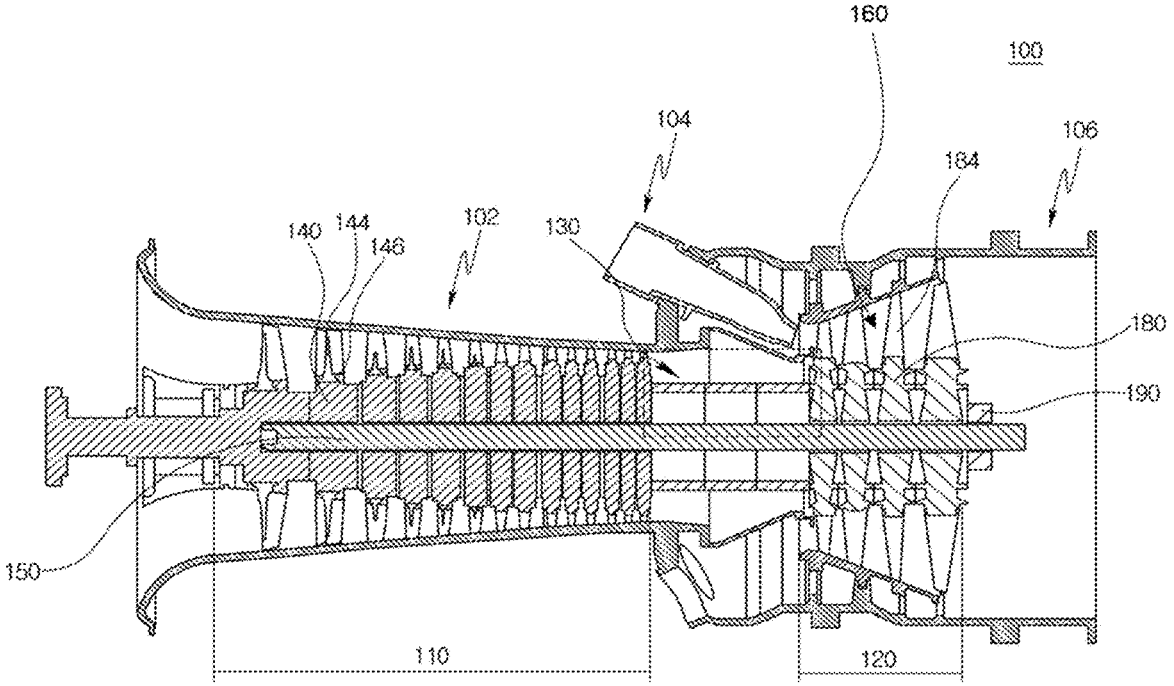
FIG. 1 is a view illustrating an overall structure of a gas turbine according to an embodiment of the present invention.

Hereinafter, exemplary embodiments will be described in greater detail with reference to the accompanying drawings. Regarding the reference numerals assigned to the elements in the drawings, it should be noted that the same elements will be specified by the same reference numerals, wherever possible, even though they are shown in different drawings. Also, in the description of exemplary embodiments, detailed description of well-known related structures or functions will be omitted when it is deemed that such description will cause ambiguous interpretation of the present disclosure.

It should be understood, however, that there is no intent to limit this disclosure to the particular exemplary embodiments disclosed. On the contrary, exemplary embodiments are to cover all modifications, equivalents, and alternatives falling within the scope of the exemplary embodiments. Like numbers refer to like elements throughout the description of the figures.

The terminology used herein is for the purpose of describing particular embodiments only and is not intended to be limiting. As used herein, the singular forms "a," "an," and "the," are intended to include the plural forms as well, unless the context clearly indicates otherwise. It will be further understood that the terms "comprises," "comprising," "includes," "including," "have/has," and/or "having," when used herein, specify the presence of stated features, integers, steps, operations, elements, and/or components, but do not preclude the presence or addition of one or more other features, integers, steps, operations, elements, components, and/or groups thereof.

In addition, terms such as first, second, A, B, (a), (b), and the like may be used herein to describe components. Each of these terminologies is not used to define an essence, order or sequence of a corresponding component but used merely to distinguish the corresponding component from other component(s). It should be noted that if it is described in the specification that one component is "connected," "coupled," or "joined" to another component, a third component may be "connected," "coupled," and "joined" between the first and second components, although the first component may be directly connected, coupled or joined to the second component.

Unless otherwise defined, all terms, including technical and scientific terms, used herein have the same meaning as commonly understood by one of ordinary skill in the art to which this disclosure pertains. Terms, such as those defined in commonly used dictionaries, are to be interpreted as having a meaning that is consistent with their meaning in the context of the relevant art, and are not to be interpreted in an idealized or overly formal sense unless expressly so defined herein.

Hereinafter, exemplary embodiments will be described in detail with reference to the accompanying drawings. The configuration and effects thereof can be clearly understood from the following description.

Figure 2:
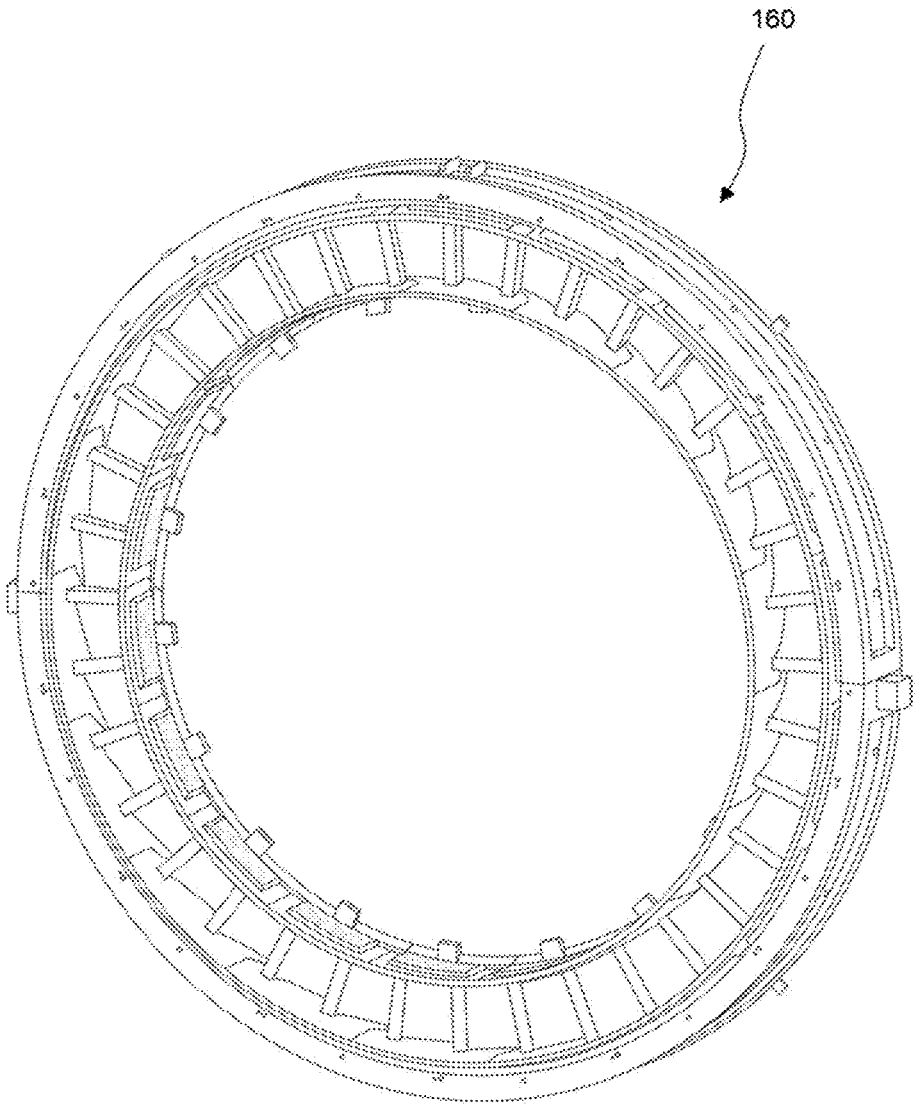
FIG. 2 is a view illustrating a stationary nozzle assembly of a gas turbine.
Figure 3:
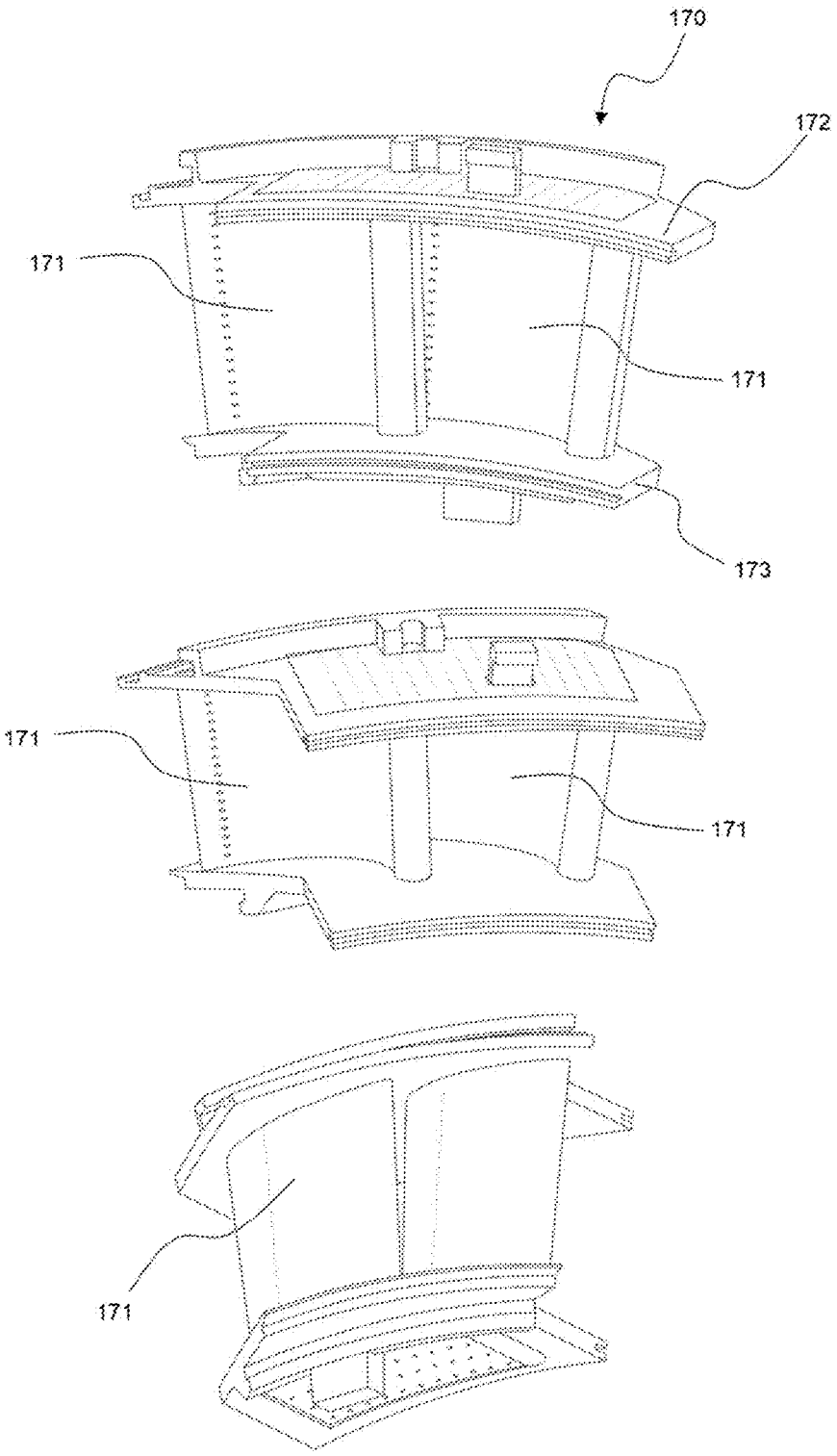
FIGS. 3 and 4 are views illustrating vane segments constituting a stationary nozzle assembly.
Figure 4:
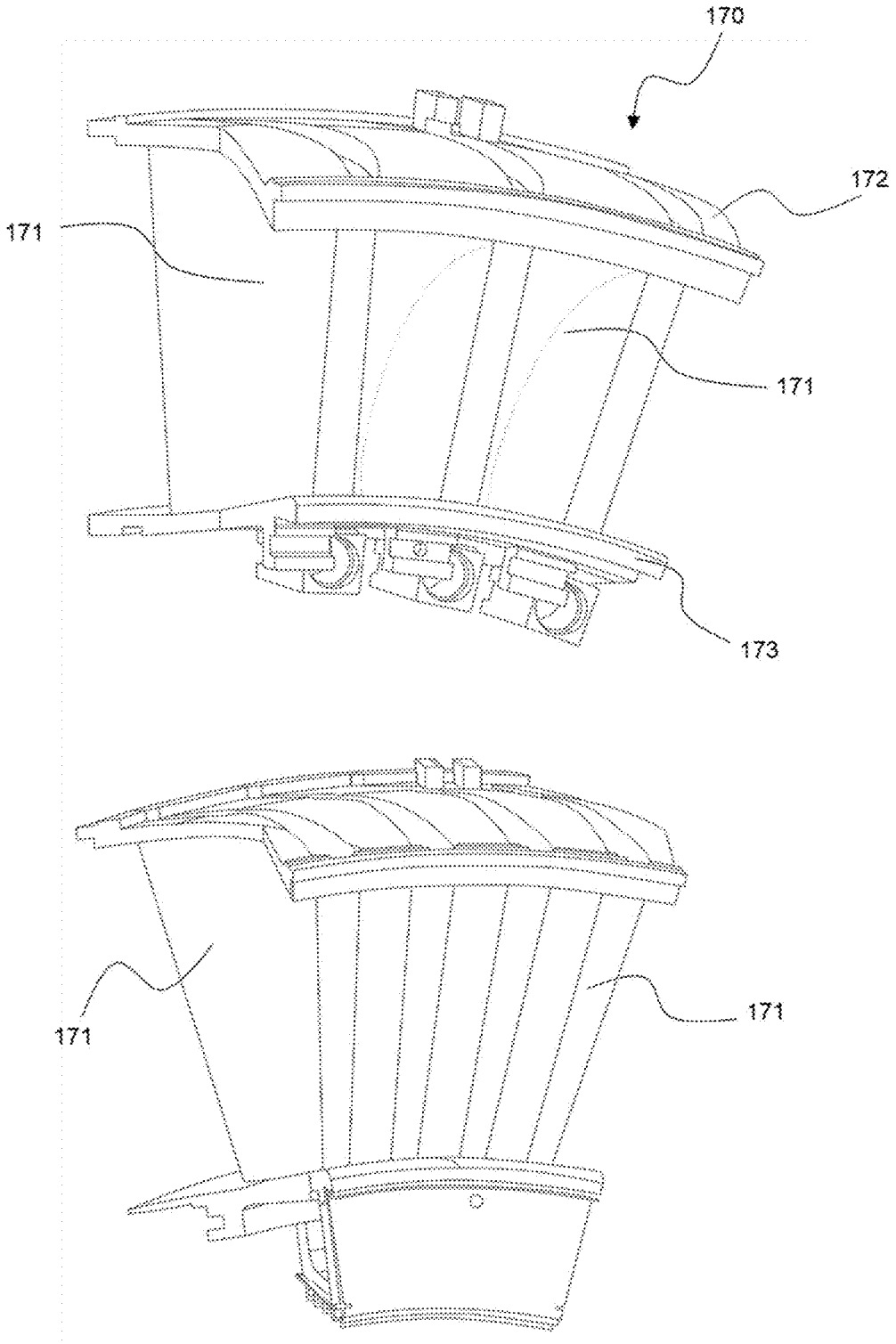
Figure 5:
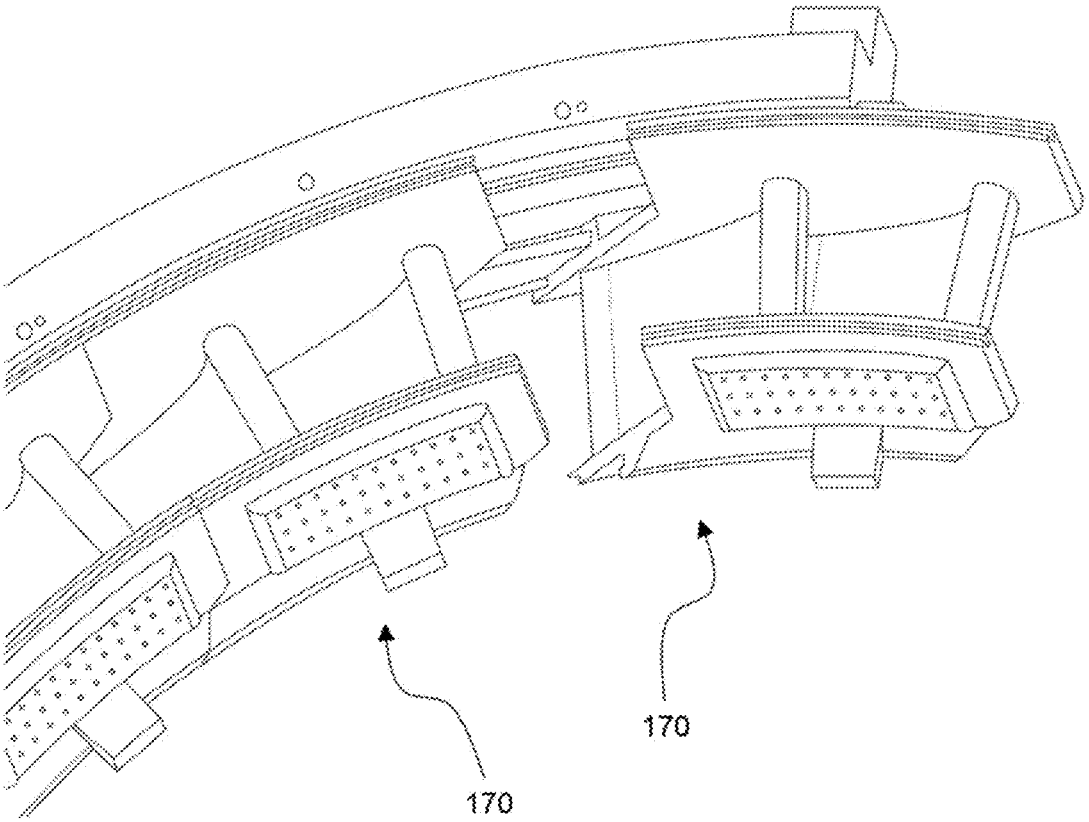
FIG. 5 is a view illustrating an assembly of vane segments to constitute a stationary nozzle assembly.
Figure 6:
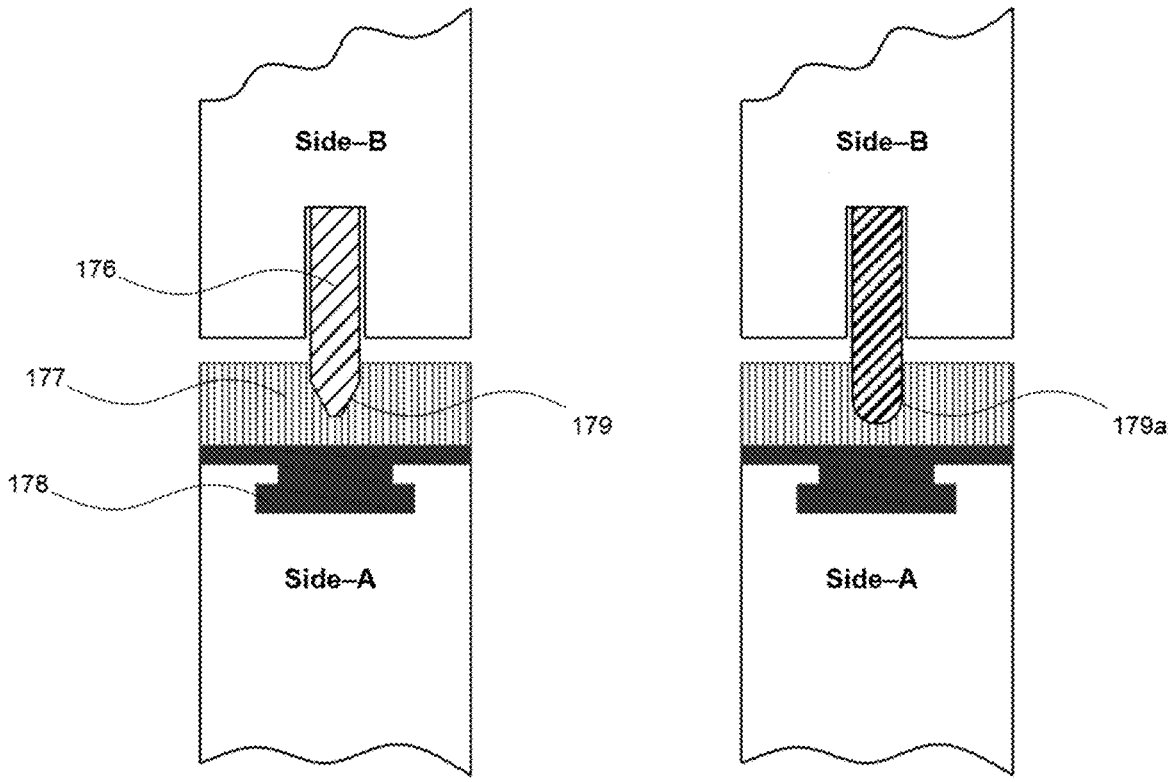
FIG. 6 is a view illustrating two adjacent vane segments coupled to each other with a fixed seal and a joint slot.
Figure 7:
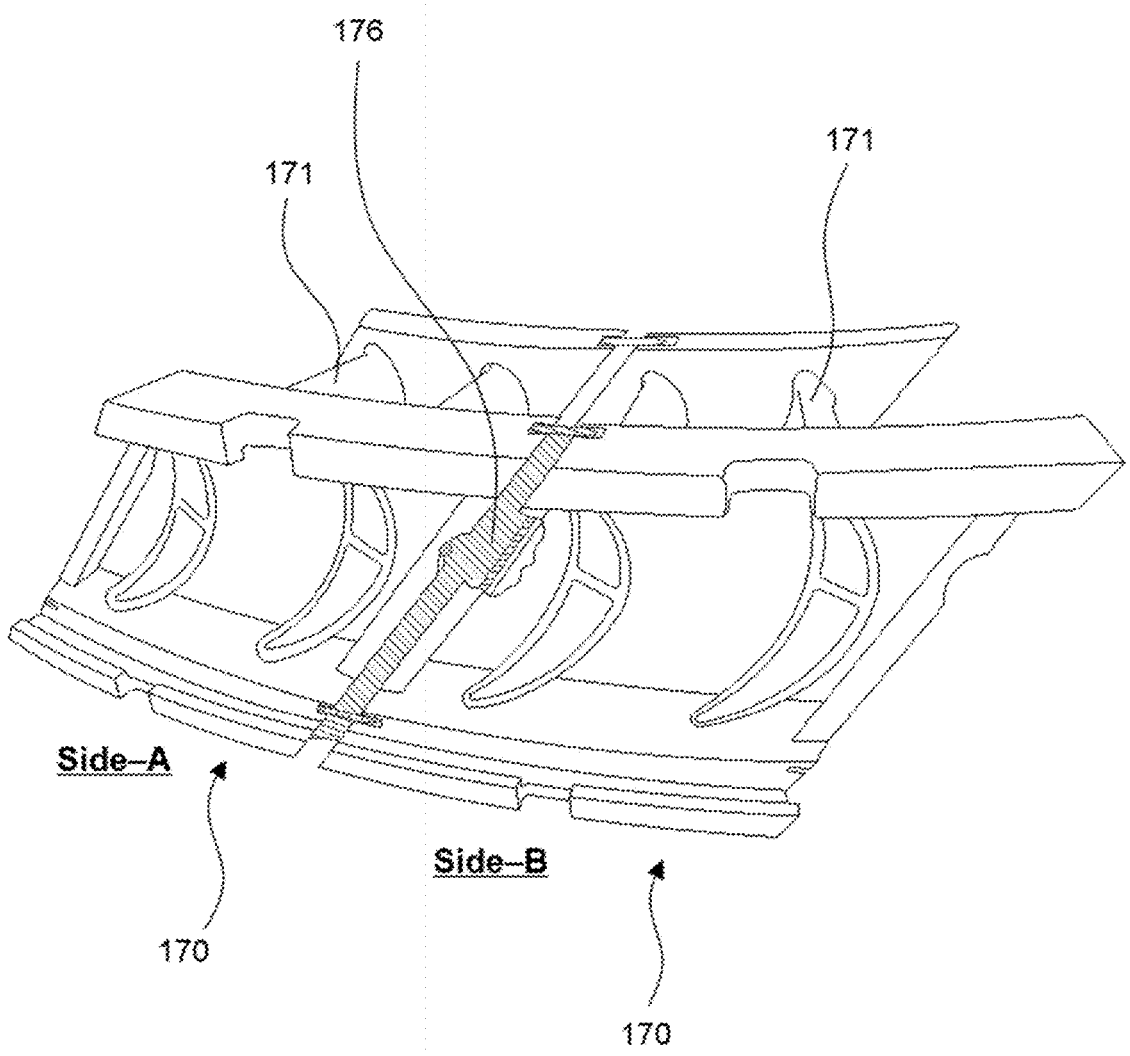
FIG. 7 is a perspective view illustrating two adjacent vane segments coupled to each other a fixed seal and a joint slot.
Figure 8:
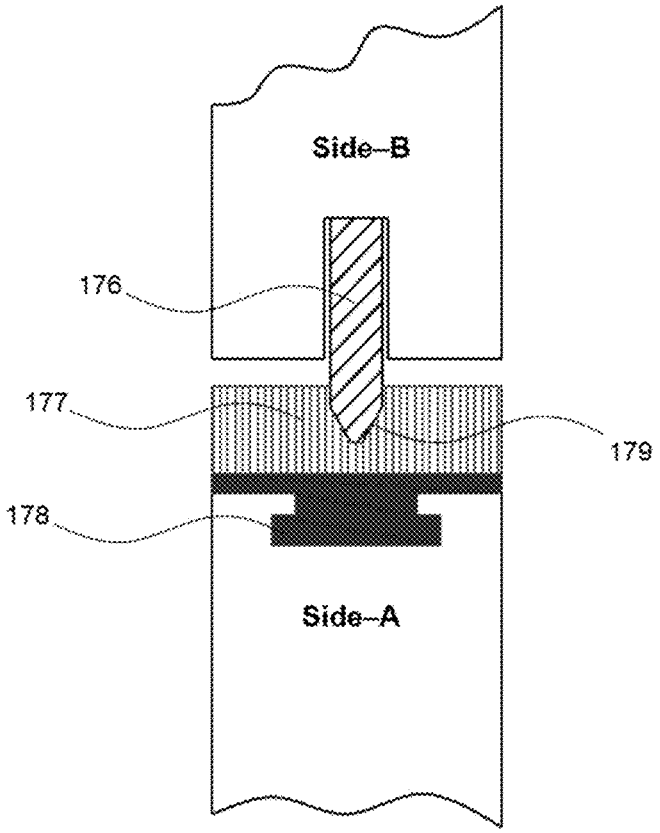
FIG. 8 is a view illustrating two adjacent vane segments coupled to each other with a fixed seal and honeycomb seal elements according to an embodiment of the present invention.
Figure 9:
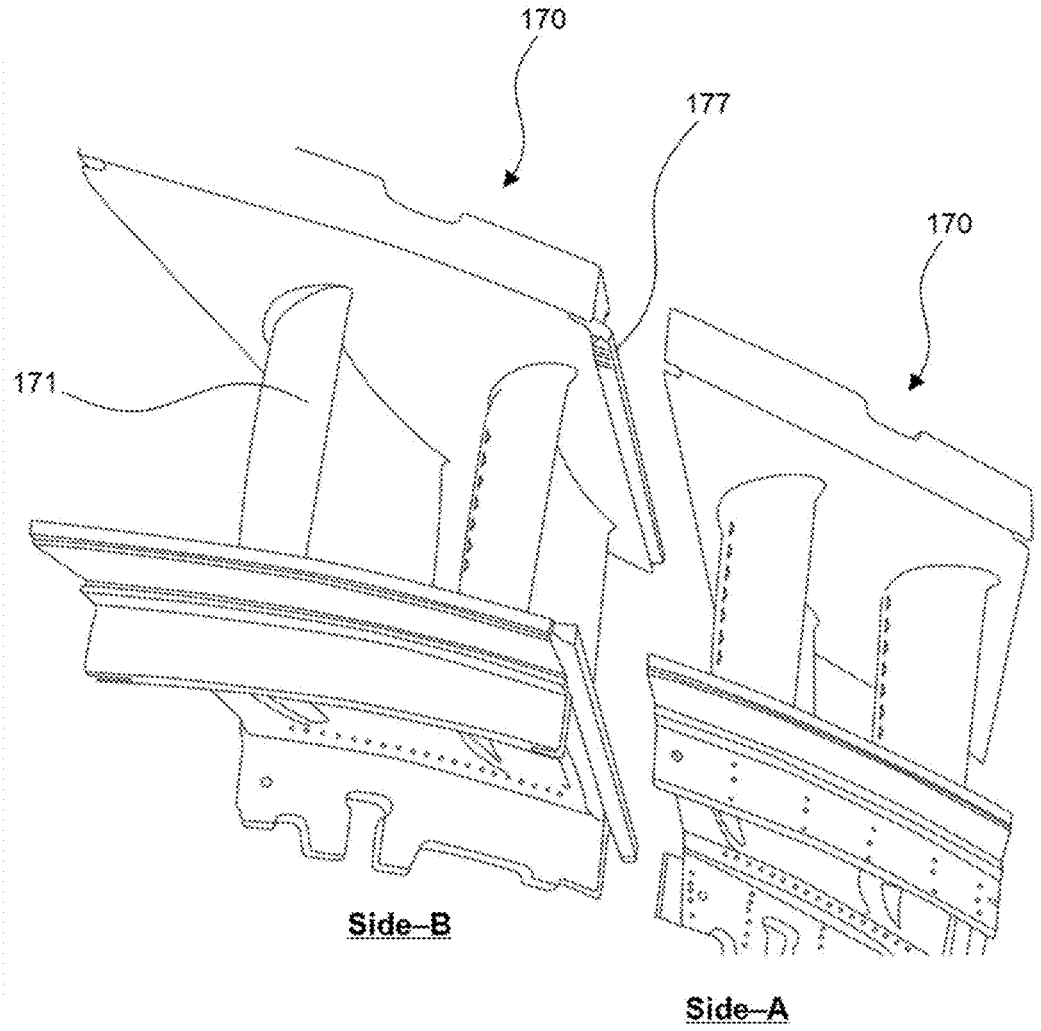
FIG. 9 is a perspective view illustrating two adjacent vane segments coupled to each other with a fixed seal and honeycomb seal elements according to an embodiment of the present invention.

FIG. 1 illustrates an overall structure of a gas turbine according to an embodiment of the present invention, and FIG. 2 is a stationary nozzle assembly of a gas turbine. FIGS. 3 and 4 show vane segments constituting the stationary nozzle assembly, while FIG. 5 shows the way to assemble the vane segments to make a stationary nozzle assembly. FIGS. 6 and 7 are view illustrating two adjacent vane segments coupled to each other with a fixed seal and a joint slot, and FIGS. 8 and 9 are views illustrating two adjacent vane segments coupled to each other with a fixed seal and honeycomb seal elements according to an embodiment of the present invention.

The gas turbine 100 includes a housing 102 and a diffuser 106. The diffuser 106 is installed at the rear of the housing 102 to discharge combustion gases passed through the gas turbine 100. The gas turbine 100 further includes a combustor 104 disposed at a portion between a compressor and the diffuser 106, and the combustor 104 receives compressed air and then combusts the fuel mixed with air.

Based on an air flow direction, a compressor section 110 is located upstream of the Combustion 104, and a turbine section 120 is located downstream thereof. A torque tube 130 is disposed between the compressor section 110 and the turbine section 120 and serves as a torque transfer member to transfer torque generated by the turbine section 120 to the compressor section 110.

The compressor section 110 includes a plurality of compressor rotor disks 140 which are fastened by a tie bolt or bolts 150 to prohibit them from being separated from each other along an axial direction.

Specifically, the compressor rotor disks 140 are aligned along the axial direction by using the tie bolt or bolts 150 inserted through central portions of the compressor rotor disks 140. The facing surfaces of the adjacent compressor rotor disks 140 are pressed against each other by the tie bolt 150 such that the compressor rotor disks 140 cannot rotate relative to each other.

The compressor rotor disk 140 has a plurality of blades 144 coupled to the outer circumferential surface thereof. The compressor blades 144 are radially disposed and each has a root part 146 fastened to the compressor rotor disk 140.

A vane is disposed between the respective compressor rotor disks 140 and fixed to the housing. Unlike the compressor rotor disks, the vane fixed to the housing does not able to rotate. The vane serves to align a flow of compressed air passed through the blades of the compressor rotor disk and guide the compressed air to the blades of another rotor disk located in the downstream side.

The root part 146 may be fastened in a tangential type or axial type. The root part 146 may be fastened through a fastening type which is selected according to a structure required by a gas turbine. The fastening type may include a dove-tail shape or a fir-tree shape. The fastening type is not limited thereto and may be modified into another fastener, for example, a key or a bolt.

The tie bolt 150 is disposed through the central portions of the plurality of compressor rotor disks 140. One end of the tie bolt 150 is fastened to the inside of the compressor rotor disk located in the most upstream side and the other end is fixed to the inside of the torque tube 130.

Since the tie bolt 150 may include various structures depending on the gas turbine, the shape of the tie bolt 150 is not limited to the shape illustrated in FIG. 1. For example, one tie bolt may be disposed through the central portions of the rotor disks as illustrated in FIG. 1, or a plurality of tie bolts may be arranged on the circumferences of the rotor disks. The two structures can be used together.

The combustor 104 mixes the compressed air with fuel and combusts the fuel mixture to generate high-temperature combustion gas with high energy, thereby raising the temperature of the combusted gas to a heat-resistant limit of the combustor and the turbine through an isobaric combustion process.

The combustion system of the gas turbine may include a plurality of combustors in a casing formed in a cell shape. Each combustor may include a burner having a fuel injection nozzle and the like, a combustor liner constituting a combustion chamber, and a transition piece serving as a connection part between the combustor and the turbine section 120.

Specifically, the combustor liner provides a combustion space in which fuel injected by the fuel injection nozzle is mixed with the compressed air pressured by the compressor and the mixture of the fuel and compressed air can be combusted. The combustor liner may include a flame tube to provide the combustion space in which the fuel mixture is combusted and a flow sleeve forming a ring-shaped space while surrounding the flame tube. The fuel injection nozzle is coupled to the front end of the combustor liner and an ignition plug may be coupled to the sidewall of the liner.

The transition piece is connected to a rear end of the combustor liner in order to transfer the high temperature combustion gas toward the turbine. The outer wall of the transition piece is cooled by the compressed air supplied from the compressor to keep the transition piece from being damaged due to the high-temperature combustion gas.

The high-temperature combustion gas coming out of the combustor is supplied to the turbine section 120. The high-temperature combustion gas is expanded and consequently apply a driving force or a reaction force to the rotating blades of the turbine, thereby generating torque with the turbine blades. Since the turbine blades are coupled to the torque tube 130, the torque generated can be transferred to the compressor section 110. In addition, power exceeding the power required for driving the compressor may be used to drive a generator or the like.

The turbine section 120 basically has a similar structure to the compressor section 10. The turbine section 120 includes a plurality of turbine rotor disks 180 similar to the compressor rotor disks 140 of the compressor section 110. Therefore, each of the turbine rotor disks 180 may include a plurality of turbine rotor blades 184 arranged in a radial shape. The turbine rotor blades 184 may also be coupled to the turbine rotor disk 180 through dove tail-shaped parts or the like.

Furthermore, a turbine stator (or a turbine vane) which is fixed to the housing is disposed between the turbine rotor blades 184 of the turbine rotor disk 180 and guides a flow direction of combustion gas passing through the blades. The turbine stator may be provided with a plurality of vane segments.

The turbine stator may include a turbine shell forming the housing, a shroud providing a rotating space for the turbine rotor blades 184 while minimizing a gap between the rotor blades and the housing, and a stationary nozzle assembly 160 in which the plurality of vane segments is continuously arranged along a circumferential direction. FIG. 2 shows an exemplary stationary nozzle assembly 160. As shown in FIG. 2, the stationary nozzle assembly 160 according to an embodiment of the present invention has a circular or an annular shape around an axis thereof.

The stationary nozzle assembly 160 according to an embodiment of the present invention may be provided with a plurality of vane segments 170. FIGS. 3 and 4 illustrate the vane segments 170. In addition, the vane segments 170 each may further include airfoil-shaped vanes 171, an outer wall 172 located at one side of the vanes and having cooling air passages, and an inner wall 173 located at another side of the vanes and having cooling air passages.

The vane segments 170 may have a plurality of vanes 171, as shown in FIGS. 3 and 4. A typical gas turbine may have three or four stages of the turbine stator. The vane segments 170 forming the stationary nozzle of the turbine stator may each have different numbers of airfoil-shaped vanes 171. For example, a first stage stationary nozzle may include the vane segments 170 having two airfoil-shaped vanes 171, and a second stage stationary nozzle may include the vane segments 170 having three airfoil-shaped vanes 171. Likewise, a third stage stationary nozzle may include the vane segments 170 having four airfoil-shaped vanes 171. The vane segments 170 forming the stationary nozzle assembly according to an embodiment of the present invention are not limited in the number of the airfoil-shaped vanes 171 and may be modified so as to increase the efficiency of the stationary nozzle in each step.

The stationary nozzle assembly may be formed by connecting the plurality of vane segments 170 along the circumferential direction of the stationary nozzle assembly. One vane segment 170 may be sequentially coupled to an adjacent vane segment 170 along the circumferential direction, as shown in FIG. 5. Accordingly, the stationary nozzle assembly 160 may be formed in an annular shape by combining the vane segments 170.

The plurality of vane segments 170 can be preferably disposed at a same distance from a center of the stationary nozzle assembly, and they may be configured to be spaced apart from each other with a uniform distance along a circumferential direction of the stationary nozzle assembly.

The turbine section 120 of the gas turbine converts thermal energy of the combustion gas into rotational energy of the turbine as the high-temperature high-pressure combustion gas passes, resulting in the rotation of the turbine disk. The turbine rotation leads to the rotation of the compressor located at a front end of the gas turbine to compress the air and drives the generator to generate electrical energy.

When one of the vane segments 170 is coupled to another vane segment 170, the high-temperature combustion gas may leak through a gap between the two adjacent vane segments 170. Such leakage of the high-temperature combustion gas reduces the turbine efficiency and therefore, adequate sealing is required between the two vane segments 170 to prevent the high-temperature combustion gas from leaking through the gap and outside of the designed flow path.

As aforementioned, the vane segments 170 of the turbine section are spaced apart from each other with a gap of a certain distance, which is referred to as a thermal gap 174 because thermal expansion occurs due to the contact with the high-temperature combustion gas. The thermal gap may be able to prevent interference with the adjacent vane segment 170 when the vane segments 170 are expanded due to the increase in temperature. However, a leakage of the combustion gas through the thermal gap is inevitable if the thermal expansion occurs unevenly, the existing sealing method deteriorates due to fretting caused by vibration or vane wall misalignment or the sealing mechanism is compromised, resulting in reduction in the turbine efficiency.

A variety of methods can be used to inhibit the gas leakage between adjacent vane segments 170. For example, the stationary nozzle assembly according to an embodiment of the present invention may further include a fixed seal 176 provided on a vane segment 170 in one side, a joint slot 175 may be located on a vane segment 170 in the other side, and the seal and the slot may be installed to face each other, thereby preventing the leakage of the combustion gas, as shown in FIGS. 6 and 7.

Alternatively, in order to suppress the leakage between the adjacent vane segments 170, the stationary nozzle assembly 160 according to an embodiment of the present invention may further include a fixed seal 176 fixed to the vane segment 170 in one side, honeycomb seal elements 177 attached to the vane segment 170 in the other side while facing the fixed seal 176, and a backing strip 178 supporting the honeycomb seal elements 177 and providing an installation space for the honeycomb seal elements 177. FIG. 8 illustrates two vane segments 170, i.e., Side-A and Side-B, having the fixed seal 176, honeycomb seal elements 177, and the backing strip 178 to inhibit the combustion gas from escaping through the gap between the two adjacent vane segments 170.

Here, when the fixed seal is installed in an end of the outer wall of the vane segment along a circumferential direction of the stationary nozzle assembly, the honeycomb seal elements may be installed in the other end of the outer wall of the vane segment along a circumferential direction of the stationary nozzle assembly. Likewise, the fixed seal may be installed in an end of the inner wall of the vane segment, and the honeycomb seal elements may be installed in the other end of the inner wall of the vane segment along a circumferential direction of the stationary nozzle assembly.

When two adjacent vane segments 170 are coupled to each other, the fixed seal 176 makes contact with the honeycomb seal elements 177. Therefore, the leakage of the combustion gas through a gap between the two adjacent vane segments 170 may be suppressed by the coupling of the fixed seal 176 and the honeycomb seal elements 177, despite the two adjacent vane segments 170 spaced part from each other.

When the adjacent vane segments 170 expand due to thermal expansion, the fixed seal 176 installed on the vane segment 170 in one side and the honeycomb seal elements 177 attached to the vane segment 170 in the other side may come closer. Therefore, the sealing between two adjacent vane segments 170 may be more firmly maintained while allow the adjacent vane segments 170 to be still spaced apart from each other.

The fixed seal 176, the honeycomb seal elements 177, and the backing strip 178 are preferably installed on an outer wall 172 or an inner wall 173 of the vane segment 170 to suppress the leakage of the combustion gas through the gap between the two adjacent vane segments 170 when the two adjacent vane segments 170 are coupled with each other. Alternatively, in the stationary nozzle assembly 160 according to an embodiment of the present invention, the fixed seal 176, the honeycomb seal elements 177, and the backing strip 178 may be installed on both the outer wall 172 and the inner wall 173 of the vane segment 170.

Referring to FIG. 9, it can be seen that when the two adjacent vane segments 170 are coupled with each other, the two adjacent vane segments 170 encounter with each other at the outer wall 172 and the inner wall 173. The vanes 171 are installed apart from each other because the vanes 171 guide the high-temperature and high-pressure combustion gas and transfers it to the turbine rotor blade in the next stage. In the stationary nozzle assembly 160 as shown in FIG. 2, it is depicted that the vanes are spaced apart from one another.

Here, the fixed seal 176, the honeycomb seal elements 177, and the backing strip 178 may need to be preferably installed on the outer wall 172 and the inner wall 173 of the vane segment 170 so as to inhibit the combustion gas from leaking through the gap between the two adjacent vane segments 170 while the vanes 171 are themselves spaced apart from each other. In this manner, it is possible to maximize the contact of the high-temperature combustion gas with the vanes, and ultimately, the thermal energy of the combustion gas may be more converted to the rotational energy of the turbine in a more efficient way.

The backing strip 178 has a T-shape to allow the backing strip 178 to be fixed to the vane segment 170. The outer wall 172 and the inner wall 173 of the vane segment 170 according to an embodiment of the present invention may be provided with a slot groove capable of accommodating the backing strip 178. Although FIG. 178 depicts a "T" Shape, any other suitable "hook" shape attachments may be utilized to secure the honeycomb to the vane or nozzle segment depending on vane or nozzle segment sidewall thickness or design.

As described above, an end of the fixed seal 176 included in the stationary nozzle assembly 160 is fixed to the vane segment 170 in one side, and the other end of the fixed seal 176 is coupled with the honeycomb seal elements 177. In order to facilitate the coupling of the fixed seal 176 and the honeycomb seal elements 177, the fixed seal 176 may be provided with a chamfered edge 179 at a portion where the fixed seal 176 is coupled to the honeycomb seal elements 177. When the two adjacent vane segments 170 are coupled with each other, the fixed seal 176 on the vane segment 170 in one side is coupled to sink into the honeycomb seal elements 177 on the vane segment 170 in the other side. In this manner, the chamfered edge 179 of the fixed seal 176 makes it easier to couple the fixed seal 176 with the honeycomb seal elements 177.

However, the end of the fixed seal 176 according to an embodiment of the present invention is not limited to the chamfered edge 179. For example, the fixed seal 176 may be provided with a round edge 179*a* at a portion where the fixed seal 176 is coupled to the honeycomb seal elements 177, as shown in FIG. 8. It is apparent to those skilled in the art that the shape of the fixed seal can be modified into various other shapes to facilitate the coupling of the fixed seal 176 with the honeycomb seal elements 177 while inhibiting the leakage of the combustion gas through the gap between the fixed seal 176 and the honeycomb seal elements 177.

The honeycomb seal elements 177 are preferably made of a nickel alloy to have resistance to high-temperature and oxidation. For example, the honeycomb seal elements 177 may be made of H-214 alloy, Hast-X alloy, or L-605 alloy. Materials of the honeycomb seal segments 177 are not limited thereto, and the honeycomb seal segments 177 may be formed of various other materials.

Although the stationary nozzle assembly has been described in detail through exemplary embodiments, the present disclosure is not limited thereto and should be construed as having the widest range according to the basic spirit disclosed herein. Those skilled in the art may implement a pattern of a form not stated above by combing or replacing the disclosed exemplary embodiments, which should also be construed as within the scope of the present disclosure. Further, it will be apparent to those skilled in the art that various modifications and variation can be easily made to these exemplary embodiments without departing from the spirit or scope of the claims.

What is claimed is:

1. A stationary nozzle assembly of a gas turbine, comprising:

a plurality of vane segments for converting hot gas energy into a kinetic form, the plurality of vane segments including two adjacent vane segments configured to be coupled to each other;

a fixed seal that is disposed between the two adjacent vane segments and includes an end portion; and honeycomb seal elements that are disposed between the two adjacent vane segments and face the fixed seal, the honeycomb seal elements configured to be coupled with the fixed seal by receiving the fixed seal when the two adjacent vane segments are coupled to each other, wherein the end portion of the fixed seal is configured to sink into the honeycomb seal elements when the fixed seal is received by the honeycomb seal elements.

2. The stationary nozzle assembly of claim 1, wherein the plurality of vane segments each comprise:

airfoil shaped vanes;

an outer wall disposed at one side of the airfoil shaped vanes; and an inner wall disposed at another side of the airfoil shaped vanes, wherein the airfoil shaped vanes are fixed to the outer wall and the inner wall.

3. The stationary nozzle assembly of claim 2, wherein the fixed seal is installed in an end portion of the outer wall of the vane segment along a circumferential direction of the stationary nozzle assembly and the honeycomb seal elements are installed in another end portion of the outer wall of the vane segment along the circumferential direction of the stationary nozzle assembly.

4. The stationary nozzle assembly of claim 3, further comprising a backing strip providing installation space for the honeycomb seal elements and on which the honeycomb seal elements are fixed.

5. The stationary nozzle assembly of claim 4, wherein the backing strip has a slot in a side such that the backing strip is coupled to the other end portion of the vane segment.

6. The stationary nozzle assembly of claim 2, wherein the fixed seal is installed in an end portion of the inner wall of the vane segment along a circumferential direction of the stationary nozzle assembly and the honeycomb seal elements are installed in another end portion of the inner wall of the vane segment along the circumferential direction of the stationary nozzle assembly.

7. The stationary nozzle assembly of claim 6, further comprising a backing strip providing installation space for the honeycomb seal elements and on which the honeycomb seal elements are fixed.

8. The stationary nozzle assembly of claim 7, wherein the backing strip has a T or L shape and has a slot in a side such that the backing strip is coupled to the other end portion of the vane segment.

9. The stationary nozzle assembly of claim 1, wherein the end portion of the fixed seal has an edge to facilitate the fixed seal to be sunk into the honeycomb seal elements.

10. The stationary nozzle assembly of claim 1, wherein the honeycomb seal elements are made of any one of H-214 alloy, Hast-X alloy, L-605 alloy, H230 or IN-718.

11. The stationary nozzle assembly of claim 1, wherein the end portion of the fixed seal has a chamfered edge to facilitate the fixed seal to be sunk into the honeycomb seal elements.

12. The stationary nozzle assembly of claim 1, wherein the end portion of the fixed seal has a round edge to facilitate the fixed seal to be sunk into the honeycomb seal elements.

13. The gas turbine of claim 1, wherein the end portion of the fixed seal has an edge to facilitate the fixed seal to be sunk into the honeycomb seal elements.

14. A gas turbine generating power, comprising:

a compressor compressing air received from the outside;

a combustor disposed downstream of the compressor, mixing the compressed air supplied from the compressor with fuel, and combusting the mixture at a constant pressure to produce a high energy combustion gas;

a turbine having a stationary nozzle assembly and turbine blades, and to which a high-temperature combustion gas produced in the combustor is supplied; and a rotating shaft connected to the compressor and the turbine to deliver rotation power generated in the turbine to the compressor, resulting in rotation of the compressor, wherein the stationary nozzle assembly comprises:

a plurality of vane segments for converting hot gas energy into a kinetic form, the plurality of vane segments including two adjacent vane segments configured to be coupled to each other;

a fixed seal that is disposed between the two adjacent vane segments and includes an end portion; and honeycomb seal elements that are disposed between the two adjacent vane segments and face the fixed seal, the honeycomb seal elements configured to be coupled with the fixed seal by receiving the fixed seal when the two adjacent vane segments are coupled to each other, wherein the end portion of the fixed seal is configured to sink into the honeycomb seal elements when the fixed seal is received by the honeycomb seal elements.

15. The gas turbine of claim 14, wherein the plurality of vane segments each comprise:

airfoil shaped vanes;

an outer wall disposed at one side of the airfoil shaped vanes; and an inner wall disposed at another side of the airfoil shaped vanes, wherein the airfoil shaped vanes are fixed to the outer wall and the inner wall.

16. The gas turbine of claim 15, wherein the fixed seal is installed in an end portion of the outer wall of the vane segment along a circumferential direction of the stationary nozzle assembly and the honeycomb seal elements are installed in another end portion of the outer wall of the vane segment along the circumferential direction of the stationary nozzle assembly.

17. The gas turbine of claim 16, further comprising a backing strip providing installation space for the honeycomb seal elements and on which the honeycomb seal elements are fixed.

18. The stationary nozzle assembly of claim 17, wherein the backing strip has a slot in a side such that the backing strip is coupled to the other end portion of the vane segment.

19. The gas turbine of claim 16, wherein the fixed seal is further installed in an end portion of the inner wall of the vane segment along a circumferential direction of the stationary nozzle assembly and the honeycomb seal elements are further installed in another end portion of the inner wall of the vane segment along the circumferential direction of the stationary nozzle assembly.

20. The gas turbine of claim 14, further comprising a backing strip providing installation space for the honeycomb seal elements and on which the honeycomb seal elements are fixed.

* * * * *